US009057389B2

(12) United States Patent
Opdenbosch

(10) Patent No.: US 9,057,389 B2
(45) Date of Patent: Jun. 16, 2015

(54) METERLESS HYDRAULIC SYSTEM HAVING MULTI-ACTUATOR CIRCUIT

(75) Inventor: Patrick Opdenbosch, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 916 days.

(21) Appl. No.: 13/250,250

(22) Filed: Sep. 30, 2011

(65) Prior Publication Data

US 2013/0081385 A1 Apr. 4, 2013

(51) Int. Cl.

| | |
|---|---|
| ***F16D 31/02*** | (2006.01) |
| ***F15B 7/00*** | (2006.01) |
| ***F15B 11/16*** | (2006.01) |
| ***F15B 13/06*** | (2006.01) |
| ***E02F 9/22*** | (2006.01) |

(52) U.S. Cl.

CPC ..... *F15B 7/006* (2013.01); *F15B 11/16* (2013.01); *F15B 13/06* (2013.01); *E02F 9/2217* (2013.01); *E02F 9/2235* (2013.01); *E02F 9/2289* (2013.01); *E02F 9/2292* (2013.01); *E02F 9/2296* (2013.01); *F15B 2211/20546* (2013.01); *F15B 2211/20561* (2013.01); *F15B 2211/27* (2013.01); *F15B 2211/3133* (2013.01); *F15B 2211/7053* (2013.01); *F15B 2211/7058* (2013.01)

(58) Field of Classification Search

CPC ..... F15B 11/16; F15B 11/17; F15B 13/06; E02F 9/2289; E02F 9/2292; E02F 9/2296

USPC ..... 60/423, 445, 472, 473, 476, 489, 490

See application file for complete search history.

(56) References Cited

U.S. PATENT DOCUMENTS

| | | | |
|---|---|---|---|
| 4,140,196 | A | 2/1979 | Brewer |
| 4,359,931 | A | 11/1982 | Palmersheim et al. |
| 4,369,625 | A | 1/1983 | Izumi et al. |
| 4,449,366 | A | 5/1984 | Sato et al. |
| 4,561,249 | A | 12/1985 | Watanabe et al. |
| 4,586,330 | A | 5/1986 | Watanabe et al. |
| 4,768,339 | A | 9/1988 | Aoyagi et al. |
| 4,833,798 | A | 5/1989 | Ehrich |
| 5,048,293 | A | 9/1991 | Aoyagi |
| 5,329,767 | A | 7/1994 | Hewett |

(Continued)

FOREIGN PATENT DOCUMENTS

| | | |
|---|---|---|
| EP | 1 598 561 | 11/2005 |
| GB | 2 269 425 | 2/1994 |

(Continued)

OTHER PUBLICATIONS

Zick, J., entitled "Verbesserte Leistungsausnutzung bei Erdbaumaschinen durch optimal Pumpensteuerung", Olhydraulic und pneumatic 20 (1976) Nr. 4.

(Continued)

*Primary Examiner* — Michael Leslie

(74) *Attorney, Agent, or Firm* — Finnegan, Henderson, Farabow, Garrett & Dunner, LLP

(57) ABSTRACT

A hydraulic system is disclosed. The hydraulic system may have a pump, a rotary actuator, a linear actuator, and a closed-loop circuit fluidly connecting the pump to the rotary and linear actuators. The hydraulic system may also have at least one valve configured to switch fluid flow direction from the pump through the linear actuator during fluid flow in a single direction through the rotary actuator.

18 Claims, 3 Drawing Sheets

(56) References Cited

U.S. PATENT DOCUMENTS

| | | | | |
|---|---|---|---|---|
| 6,330,797 | B1 | 12/2001 | Kondo | |
| 6,691,603 | B2 | 2/2004 | Linerode et al. | |
| 6,745,992 | B2 | 6/2004 | Yang et al. | |
| 6,789,335 | B1 | 9/2004 | Kinugawa et al. | |
| 6,918,247 | B1 | 7/2005 | Warner | |
| 7,243,591 | B2 | 7/2007 | Dixen et al. | |
| 7,260,931 | B2 | 8/2007 | Egelja et al. | |
| 7,272,928 | B2 | 9/2007 | Ariga et al. | |
| 7,412,827 | B2 | 8/2008 | Verkuilen | |
| 7,434,391 | B2 | 10/2008 | Asam et al. | |
| 7,490,421 | B1 | 2/2009 | Pletzer et al. | |
| 7,516,613 | B2 | 4/2009 | Kadlicko | |
| 7,543,449 | B2 * | 6/2009 | Ivantysynova et al. | 60/476 |
| 2004/0083629 | A1 | 5/2004 | Kondou | |
| 2004/0123499 | A1 | 7/2004 | Arii | |
| 2005/0012337 | A1 | 1/2005 | Yoshimatsu | |
| 2005/0036894 | A1 | 2/2005 | Oguri | |
| 2007/0044463 | A1 | 3/2007 | VerKuilen et al. | |
| 2008/0250783 | A1 | 10/2008 | Griswold | |
| 2008/0300757 | A1 | 12/2008 | Kanayama et al. | |
| 2008/0314038 | A1 | 12/2008 | Tozawa et al. | |
| 2009/0165450 | A1 | 7/2009 | Cherney et al. | |
| 2009/0266934 | A1 * | 10/2009 | Makino | 417/44.2 |
| 2009/0288408 | A1 | 11/2009 | Tozawa et al. | |
| 2010/0000209 | A1 | 1/2010 | Wada et al. | |
| 2010/0000211 | A1 | 1/2010 | Ikeda et al. | |
| 2010/0043420 | A1 | 2/2010 | Ikeda et al. | |
| 2010/0107620 | A1 | 5/2010 | Nelson et al. | |
| 2010/0115936 | A1 | 5/2010 | Williamson et al. | |
| 2010/0162593 | A1 | 7/2010 | Hughes, IV et al. | |
| 2010/0162885 | A1 | 7/2010 | Hughes, IV et al. | |
| 2010/0163258 | A1 | 7/2010 | Hughes, IV et al. | |
| 2010/0218493 | A1 | 9/2010 | Nakamura et al. | |
| 2011/0029206 | A1 | 2/2011 | Kang et al. | |
| 2011/0030364 | A1 | 2/2011 | Persson et al. | |

FOREIGN PATENT DOCUMENTS

| | | | |
|---|---|---|---|
| JP | 56-016735 | | 2/1981 |
| JP | 57-054635 | A | 4/1982 |
| JP | 57-134007 | | 8/1982 |
| JP | 58-044133 | | 3/1983 |
| JP | 59-233030 | A | 12/1984 |
| JP | 02-108733 | | 4/1990 |
| JP | 06-057786 | | 3/1994 |
| JP | 10-96402 | | 4/1998 |
| JP | 2006-118685 | | 5/2006 |
| JP | 2007-247701 | | 9/2007 |
| JP | 2011-069432 | | 4/2011 |
| WO | WO 2005/024246 | | 3/2005 |
| WO | WO 2009/084853 | | 7/2009 |
| WO | WO 2009/123047 | | 10/2009 |
| WO | WO 2010/040890 | | 4/2010 |
| WO | WO 2011/041410 | | 4/2011 |

OTHER PUBLICATIONS

Linjama, M. (2011) entitled "Digital Fluid Power-State of the Art", The 12$^{th}$ Scandinavian International Conference on Fluid Power, May 18-20, 2011 Tampere, Finland.

Zimmerman, J. PhD Student/Purdue University, Center for Compact and Efficient Fluid Power PowerPoint Presentation, Annual Meeting (Jun. 14).

Zimmerman, J. et al., "Hybrid Displacement Controlled Multi-Actuator Hydraulic Systems", The Twelfth Scandinavian International Conference on Fluid Power , Tampere, Finland (May 18-20, 2011).

Brezonick, M., entitled "The Potential of Pump-Controlled Hydraulics", Hydraulic Horizons, Diesel Progress North American Edition (Jan. 2009).

Linde Hydraulics Brochure entitled "HPV-02. Variable Pumps for Closed Loop Operation", available at least as early as Aug. 31, 2011, pp. 1-36.

* cited by examiner

METERLESS HYDRAULIC SYSTEM HAVING MULTI-ACTUATOR CIRCUIT

TECHNICAL FIELD

The present disclosure relates generally to a hydraulic system and, more particularly, to a meterless hydraulic system having a multi-actuator circuit.

BACKGROUND

A conventional hydraulic system includes a pump that draws low-pressure fluid from a tank, pressurizes the fluid, and makes the pressurized fluid available to multiple different actuators for use in moving the actuators. In this arrangement, a speed of each actuator can be independently controlled by selectively throttling (e.g., restricting) a flow of the pressurized fluid from the pump into each actuator. For example, to move a particular actuator at a high speed, the flow of fluid from the pump into the actuator is restricted by only a small amount. In contrast, to move the same or another actuator at a low speed, the restriction placed on the flow of fluid is increased. Although adequate for many applications, the use of fluid restriction to control actuator speed can result in flow losses that reduce an overall efficiency of a hydraulic system.

An alternative type of hydraulic system is known as a meterless hydraulic system. A meterless hydraulic system generally includes a pump connected in closed-loop fashion to a single actuator or to a pair of actuators operating in tandem. During operation, the pump draws fluid from one chamber of the actuator(s) and discharges pressurized fluid to an opposing chamber of the same actuator(s). To move the actuator(s) at a higher speed, the pump discharges fluid at a faster rate. To move the actuator with a lower speed, the pump discharges the fluid at a slower rate. A meterless hydraulic system is generally more efficient than a conventional hydraulic system because the speed of the actuator(s) is controlled through pump operation as opposed to fluid restriction. That is, the pump is controlled to only discharge as much fluid as is necessary to move the actuator(s) at a desired speed, and no throttling of a fluid flow is required.

An exemplary meterless hydraulic system is disclosed in a technical document titled "Test Bed 1—Heavy Mobile Equipment" by Zimmerman et al. presented in the Jun. 14, 2010 annual meeting of the National Science Foundation. In this document, a meterless hydraulic system is described that has a multi-actuator circuit. The hydraulic system includes an over-center, variable displacement pump connected in closed-loop fashion to a travel motor and a hydraulic cylinder. Isolation valves are associated with both the travel motor and the hydraulic cylinder to allow sequential operation of the two actuators. Pairing of multiple actuators with a single pump helps to reduce a number of pumps required for the hydraulic system.

Although the meterless hydraulic system of the technical document described above discloses a multi-actuator circuit, the system may still be less than optimal. In particular, the system does not provide for simultaneous use of the travel motor and hydraulic cylinder, much less simultaneous use with independent speed control or simultaneous use with reversing actuation directions.

The hydraulic system of the present disclosure is directed toward solving one or more of the problems set forth above and/or other problems of the prior art.

SUMMARY

In one aspect, the present disclosure is directed to a hydraulic system. The hydraulic system may include a pump, a rotary actuator, a linear actuator, and a closed-loop circuit fluidly connecting the pump to the rotary and linear actuators. The hydraulic system may also include at least one valve configured to switch fluid flow direction from the pump through the linear actuator during fluid flow in a single direction through the rotary actuator.

In another aspect, the present disclosure is directed to a method of operating a hydraulic system. The method may include pressurizing fluid with a pump, directing fluid pressurized by the pump to a motor and a linear actuator, and returning fluid from the motor and linear actuator to the pump via a closed-loop circuit. The method may also include receiving an indication of operator desired movement of the motor and linear actuator, and adjusting operation of the pump based on the indication. Adjusting operation of the pump may include adjusting operation of the pump based on only desired movement of the motor when movement of the linear actuator is not desired, adjusting operation of the pump based on only desired movement of the linear actuator anytime movement of the linear actuator is desired, and adjusting operation of the motor based on desired movement of the motor when movement of both the motor and the linear actuator is desired.

DETAILED DESCRIPTION

Figure 1:
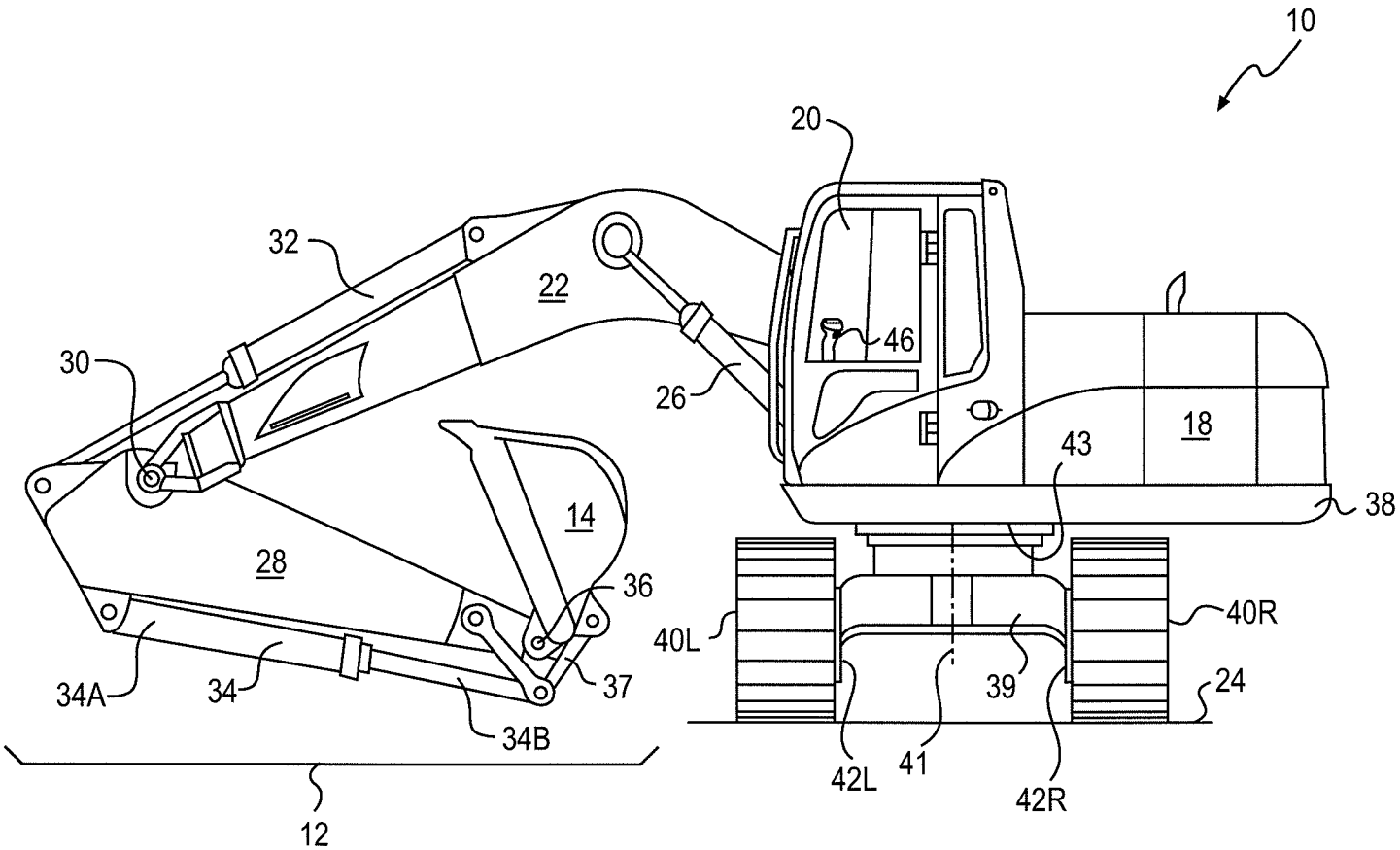
FIG. 1 is a pictorial illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or another industry known in the art. For example, machine 10 may be an earth moving machine such as an excavator (shown in FIG. 1), a dozer, a loader, a backhoe, a motor grader, a dump truck, or any other earth moving machine. Machine 10 may include an implement system 12 configured to move a work tool 14, a drive system 16 for propelling machine 10, a power source 18 that provides power to implement system 12 and drive system 16, and an operator station 20 situated for manual control of implement system 12, drive system 16, and/or power source 18.

Implement system 12 may include a linkage structure acted on by fluid actuators to move work tool 14. Specifically, implement system 12 may include a boom 22 that is vertically pivotal about a horizontal axis (not shown) relative to a work surface 24 by a pair of adjacent, double-acting, hydraulic cylinders 26 (only one shown in FIG. 1). Implement system 12 may also include a stick 28 that is vertically pivotal about a horizontal axis 30 by a single, double-acting, hydraulic cylinder 32. Implement system 12 may further include a single, double-acting, hydraulic cylinder 34 that is operatively connected between stick 28 and work tool 14 to pivot work tool 14 vertically about a horizontal pivot axis 36. In the disclosed embodiment, hydraulic cylinder 34 is connected at a head-end 34A to a portion of stick 28 and at an opposing rod-end 34B to work tool 14 by way of a power link 37. Boom 22 may be pivotally connected to a body 38 of machine 10. Body 38 may be pivotally connected to an undercarriage 39 and movable about a vertical axis 41 by a hydraulic swing motor 43. Stick 28 may pivotally connect boom 22 to work tool 14 by way of axis 30 and 36.

Numerous different work tools 14 may be attachable to a single machine 10 and operator controllable. Work tool 14 may include any device used to perform a particular task such as, for example, a bucket, a fork arrangement, a blade, a shovel, a ripper, a dump bed, a broom, a snow blower, a propelling device, a cutting device, a grasping device, or any other task-performing device known in the art. Although connected in the embodiment of FIG. 1 to pivot in the vertical direction relative to body 38 of machine 10 and to swing in the horizontal direction, work tool 14 may alternatively or additionally rotate, slide, open and close, or move in any other manner known in the art.

Drive system 16 may include one or more traction devices powered to propel machine 10. In the disclosed example, drive system 16 includes a left track 40L located on one side of machine 10, and a right track 40R located on an opposing side of machine 10. Left track 40L may be driven by a left travel motor 42L, while right track 40R may be driven by a right travel motor 42R. It is contemplated that drive system 16 could alternatively include traction devices other than tracks such as wheels, belts, or other known traction devices. Machine 10 may be steered by generating a speed and/or rotational direction difference between left and right travel motors 42L, 42R, while straight travel may be facilitated by generating substantially equal output speeds and rotational directions from left and right travel motors 42L, 42R.

Power source 18 may embody an engine such as, for example, a diesel engine, a gasoline engine, a gaseous fuel-powered engine, or any other type of combustion engine known in the art. It is contemplated that power source 18 may alternatively embody a non-combustion source of power such as a fuel cell, a power storage device, or another source known in the art. Power source 18 may produce a mechanical or electrical power output that may then be converted to hydraulic power for moving hydraulic cylinders 26, 32, 34 and left travel, right travel, and swing motors 42L, 42R, 43.

Operator station 20 may include devices that receive input from a machine operator indicative of desired machine maneuvering. Specifically, operator station 20 may include one or more operator interface devices 46, for example a joystick, a steering wheel, or a pedal, that are located proximate an operator seat (not shown). Operator interface devices 46 may initiate movement of machine 10, for example travel and/or tool movement, by producing displacement signals that are indicative of desired machine maneuvering. As an operator moves interface device 46, the operator may affect a corresponding machine movement in a desired direction, with a desired speed, and/or with a desired force.

Figure 2:
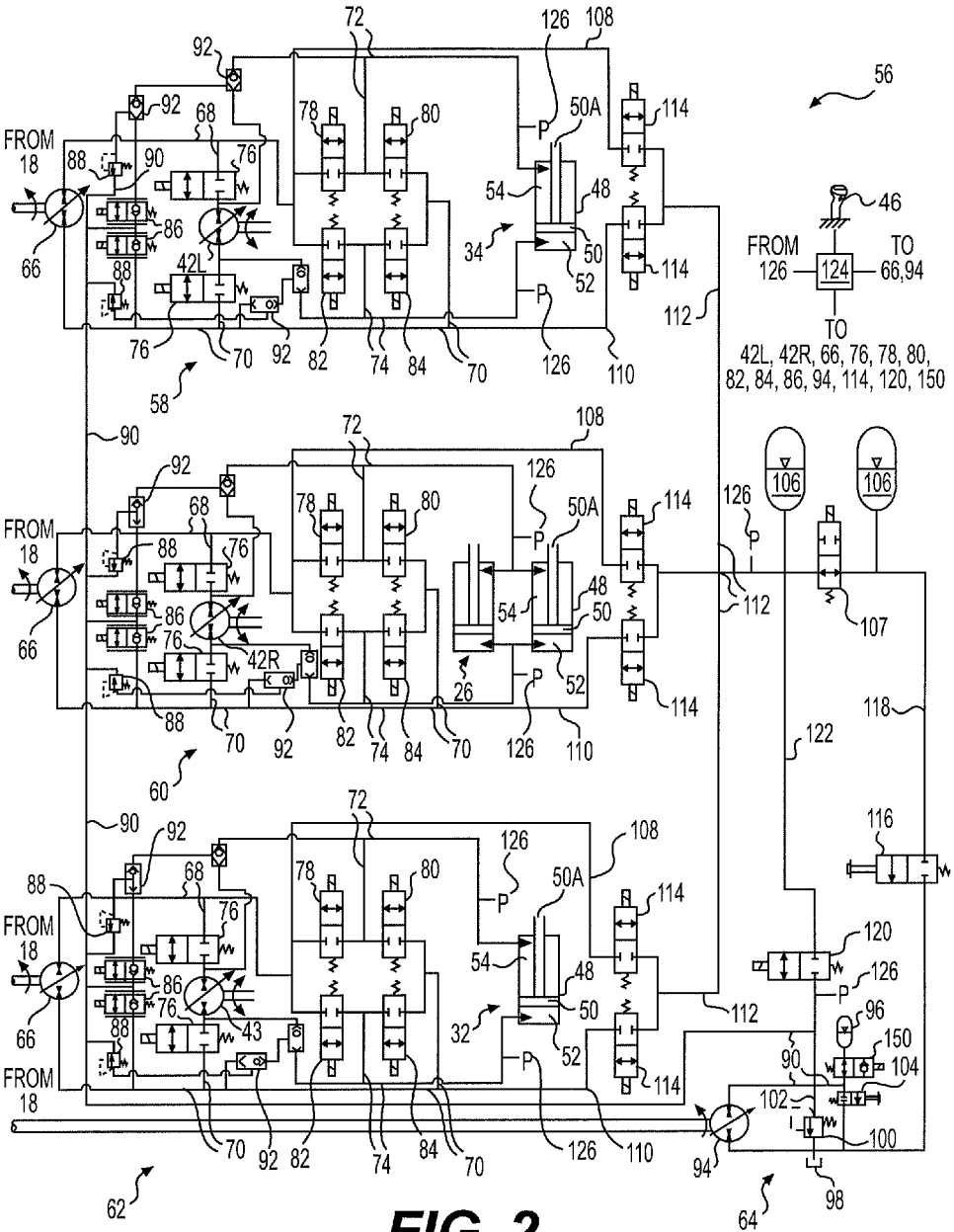
FIG. 2 is a schematic illustration of an exemplary disclosed hydraulic system that may be used in conjunction with the machine of FIG. 1.

As shown in FIG. 2, hydraulic cylinders 26, 32, 34 may each include a tube 48 and a piston assembly 50 arranged within tube 48 to form a first chamber 52 and an opposing second chamber 54. In one example, a rod portion 50A of piston assembly 50 may extend through an end of second chamber 54. As such, second chamber 54 may be considered the rod-end chamber of hydraulic cylinders 26, 32, 34, while first chamber 52 may be considered the head-end chamber.

First and second chambers 52, 54 may each be selectively supplied with pressurized fluid and drained of the pressurized fluid to cause piston assembly 50 to displace within tube 48, thereby changing an effective length of hydraulic cylinders 26, 32, 34 and moving work tool 14 (referring to FIG. 1). A flow rate of fluid into and out of first and second chambers 52, 54 may relate to a translational velocity of hydraulic cylinders 26, 32, 34, while a pressure differential between first and second chambers 52, 54 may relate to a force imparted by hydraulic cylinders 26, 32, 34 on the associated linkage structure of implement system 12.

Swing motor 43, like hydraulic cylinders 26, 32, 34, may be driven by a fluid pressure differential. Specifically, swing motor 43 may include first and second chambers (not shown) located to either side of a pumping mechanism such as an impeller, plunger, or series of pistons (not shown). When the first chamber is filled with pressurized fluid and the second chamber is drained of fluid, the pumping mechanism may be urged to move or rotate in a first direction. Conversely, when the first chamber is drained of fluid and the second chamber is filled with pressurized fluid, the pumping mechanism may be urged to move or rotate in an opposite direction. The flow rate of fluid into and out of the first and second chambers may determine an output velocity of swing motor 43, while a pressure differential across the pumping mechanism may determine an output torque. It is contemplated that a displacement of swing motor 43 may be variable, if desired, such that for a given flow rate and/or pressure of supplied fluid, a speed and/or torque output of swing motor 43 may be adjusted.

Similar to swing motor 43, each of left and right travel motors 42L, 42R may be driven by creating a fluid pressure differential. Specifically, each of left and right travel motors 42L, 42R may include first and second chambers (not shown) located to either side of a pumping mechanism (not shown). When the first chamber is filled with pressurized fluid and the second chamber is drained of fluid, the pumping mechanism may be urged to move or rotate a corresponding traction device (40L, 40R) in a first direction. Conversely, when the first chamber is drained of the fluid and the second chamber is filled with the pressurized fluid, the respective pumping mechanism may be urged to move or rotate the traction device in an opposite direction. The flow rate of fluid into and out of the first and second chambers may determine a velocity of left and right travel motors 42L, 42R, while a pressure differential between left and right travel motors 42L, 42R may determine a torque. It is contemplated that a displacement of left and right travel motors 42L, 42R may be variable, if desired, such that for a given flow rate and/or pressure of supplied fluid, a speed and/or torque output of travel motors 42L, 42R may be adjusted.

As illustrated in FIG. 2, machine 10 may include a hydraulic system 56 having a plurality of fluid components that cooperate to move work tool 14 (referring to FIG. 1) and machine 10. In particular, hydraulic system 56 may include, among other things, a first meterless circuit 58, a second meterless circuit 60, a third meterless circuit 62, and a charge circuit 64. First meterless circuit 58 may be a bucket circuit associated with hydraulic cylinder 34 and left travel motor 42L. Second meterless circuit 60 may be a boom circuit associated with hydraulic cylinders 26 and right travel motor 42R. Third circuit 62 may be a stick circuit associated with hydraulic cylinder 32 and swing motor 43. Charge circuit 64 may be in selective fluid communication with each of first, second, and third meterless circuits 58, 60, 62. It is contemplated that additional and/or different configurations of meterless circuits may be included within hydraulic system 56 such as, for example, an independent circuit associated with each separate actuator (e.g., hydraulic cylinders 32, 34, 26, left travel motor 42L, right travel motor 42R, and/or swing motor 43), if desired.

In the disclosed embodiment, each of first, second, and third meterless circuits 58, 60, 62 may be substantially identical and include a plurality of interconnecting and cooperating fluid components that facilitate the use and control of the associated actuators. For example, each meterless circuit 58, 60, 62 may include a pump 66 fluidly connected to its associated rotary and linear actuators in parallel via a closed-loop formed by upper-side and lower-side (relative to FIG. 2) passages. Specifically, each pump 66 may be connected to its rotary actuator (e.g., to left-travel motor 42L, right travel motor 42R, or swing motor 43) via a first pump passage 68 and a second pump passage 70. In addition, each pump 66 may be connected to its linear actuator (e.g., to hydraulic cylinder 26, 32, or 34) via first and second pump passages 68, 70, a rod-end passage 72, and a head-end passage 74. To cause the rotary actuator to rotate in a first direction, first pump passage 68 may be filled with fluid pressurized by pump 66, while second pump passage 70 may be filled with fluid exiting the rotary actuator. To reverse direction of the rotary actuator, second pump passage 70 may be filled with fluid pressurized by pump 66, while first pump passage 68 may be filled with fluid exiting the rotary actuator. During an extending operation of a particular linear actuator, head-end passage 74 may be filled with fluid pressurized by pump 66, while rod-end passage 72 may be filled with fluid returned from the linear actuator. In contrast, during a retracting operation, rod-end passage 72 may be filled with fluid pressurized by pump 66, while head-end passage 74 may be filled with fluid returned from the linear actuator.

Each pump 66 may have variable displacement and be controlled to draw fluid from its associated actuators and discharge the fluid at a specified elevated pressure back to the actuators in two different directions. That is, pump 66 may include a stroke-adjusting mechanism, for example a swash-plate, a position of which is hydro-mechanically adjusted based on, among other things, a desired speed of the actuators to thereby vary an output (e.g., a discharge rate) of pump 66. The displacement of pump 66 may be adjusted from a zero displacement position at which substantially no fluid is discharged from pump 66, to a maximum displacement position in a first direction at which fluid is discharged from pump 66 at a maximum rate into first pump passage 68. Likewise, the displacement of pump 66 may be adjusted from the zero displacement position to a maximum displacement position in a second direction at which fluid is discharged from pump 66 at a maximum rate into second pump passage 70. Pump 66 may be drivably connected to power source 18 of machine 10 by, for example, a countershaft, a belt, or in another suitable manner. Alternatively, pump 66 may be indirectly connected to power source 18 via a torque converter, a gear box, an electrical circuit, or in any other manner known in the art. It is contemplated that pumps 66 of different circuits may be connected to power source 18 in tandem (e.g., via the same shaft) or in parallel (via a gear train), as desired.

Pump 66 may also be selectively operated as a motor. More specifically, when an associated actuator is operating in an overrunning condition, the fluid discharged from the actuator may have a pressure elevated higher than an output pressure of pump 66. In this situation, the elevated pressure of the actuator fluid directed back through pump 66 may function to drive pump 66 to rotate with or without assistance from power source 18. Under some circumstances, pump 66 may even be capable of imparting energy to power source 18, thereby improving an efficiency and/or capacity of power source 18.

During some operations, it may be desirable to cause movement of a linear actuator without causing movement of the associated rotary actuator within the same circuit. For this purpose, each of meterless circuits 58, 60, 62 may be provided with isolation valves 76 capable of substantially isolating the rotary actuator from its associated pump 66 and linear actuator. Isolation valves 76, in the disclosed embodiment, may be on/off type valves that are solenoid-actuated toward a flow-passing position and spring-biased toward a flow-blocking position. When isolation valves 76 are in the flow-passing position, fluid may flow substantially unrestricted between first and second pump passages 68, 70 by way of the rotary actuator. When isolation valves 76 are in the flow-blocking position, fluid flows within first and second pump passages 68, 70 may not pass through and substantially affect the motion of the rotary actuator. In addition to isolating the rotary actuator from operation of pump 66 and movement of the linear actuator, isolation valves 76 may also function as load-holding valves, hydraulically locking movement of the rotary actuator, when the rotary actuator has a non-zero displacement and isolation valves 76 are in their flow-blocking positions.

The linear actuator of each meterless circuit 58, 60, 62 may likewise be provided with valves used for isolation of the linear actuator. In particular, each of meterless circuits 58, 60, 62 may be provided with four valves, including a first rod-end valve 78, a second rod-end valve 80, a first head-end valve 82, and a second head-end valve 84. First rod-end valve 78 may be positioned between first pump passage 68 and rod-end passage 72. Second rod-end valve 80 may be positioned between second pump passage 70 and rod-end passage 72. First head-end valve 82 may be positioned between first pump passage 68 and head-end passage 74. Second head-end valve 84 may be positioned between second pump passage 70 and head-end passage 74. Like isolation valves 76, valves 78, 80, 82, 84 may be on/off type valves that are solenoid-actuated toward a flow-passing position, and spring-biased toward a flow-blocking position. To isolate a linear actuator from its associated pump 66 and rotary actuator and to hydraulically lock movement of the linear actuator, all of valves 78, 80, 82, 84 may be moved to their flow-blocking positions.

Valves 78, 80, 82, 84, in addition to facilitating isolation of the associated linear actuator, may also provide flow-switching functionality. In particular, there may be times when movement of the rotary actuator in the first direction and retraction of the linear actuator is desired, while at other times movement of the rotary actuator in the first direction and extension of the linear actuator is desired. During the first situation, pump 66 may be required to pressurize first pump passage 68 and rod-end passage 72, while during the second situation, pump 66 may be required to pressurize first pump passage 68 and head-end passage 74. Valves 78, 80, 82, 84 may facilitate these operations. For example, when first pump passage 68 is pressurized by pump 66 and retraction of the linear actuator is desired, first rod-end valve 78 may be moved to its flow-passing position such that rod-end passage 72 and second chamber 54 of the linear actuator are also pressurized. At this same time, second head-end valve 84 may be in its flow-passing position such that fluid discharged from first chamber 52 passes through head-end passage 74 to second pump passage 70 and back to pump 66. In contrast, when first pump passage 68 is pressurized by pump 66 and extension of the linear actuator is desired, first head-end valve 82 may be moved to its flow-passing position such that head-end passage 74 and first chamber 52 of the linear actuator are also pressurized. At this same time, second rod-end valve 80 may be in its flow-passing position such that fluid discharged from second chamber 54 passes through rod-end passage 72 to second pump passage 70 and back to pump 66. Similar movements of valves 78, 80, 82, 84 may be initiated to provide for movement of the rotary actuator in the second direction during extensions and retractions of the linear actuator.

In some embodiments, valves 78, 80, 82, and 84 may be used to facilitate fluid regeneration within the associated linear actuator. For example, when valves 80, 84 are moved to their flow passing positions and valves 78, 82 are in their flow-blocking positions, high-pressure fluid may be transferred from one chamber to the other of the linear actuator via valves 80, 84, without the fluid ever passing through pump 66. Similar functionality may alternatively be achieved by moving valves 78, 82 to their flow-passing positions while holding valves 80, 84 in their flow-blocking positions.

It will be appreciated by those of skill in the art that the respective rates of hydraulic fluid flow into and out of first and second chambers 52, 54 of hydraulic cylinders 26, 32, 34 during extension and retraction may not be equal. That is, because of the location of rod portion 50A within second chamber 54, piston assembly 50 may have a reduced pressure area within second chamber 54, as compared with a pressure area within first chamber 52. Accordingly, during retraction of hydraulic cylinders 26, 32, 34, more hydraulic fluid may be forced out of first chamber 52 than can be consumed by second chamber 54 and, during extension, more hydraulic fluid may be consumed by first chamber 52 than is forced out of second chamber 54. In order to accommodate the excess fluid discharge during retraction and the additional fluid required during extension, each of meterless circuits 58, 60, 62 may be provided with two makeup valves 86 and two relief valves 88 that connect first and second pump passages 68, 70 to charge circuit 64 via a common passage 90.

Makeup valves 86 may each be a variable position valve that is disposed between common passage 90 and one of first and second pump passages 68, 70 and configured to selectively allow pressurized fluid from charge circuit 64 to enter first and second pump passages 68, 70. In particular, each of makeup valves 86 may be solenoid-actuated from a first position at which fluid freely flows between common passage 90 and the respective first and second pump passage 68, 70, toward a second position at which fluid from common passage 90 may flow only into first and second pump passage 68, 70 when a pressure of common passage 90 exceeds the pressure of first and second pump passages 68, 70 by a threshold amount. Makeup valves 86 may be spring-biased toward their second positions, and only moved toward their first positions during operations known to have need of positive or negative makeup fluid. Makeup valves 86 may also be used to facilitate fluid regeneration between first and second pump passages 68, 70 within a particular circuit, by simultaneously moving together at least partway to their first positions.

Relief valves 88 may be provided to allow fluid relief from each meterless circuit 58, 60, 62 into charge circuit 64 when a pressure of the fluid exceeds a set threshold of relief valves 88. Relief valves 88 may be set to operate at relatively high pressure levels in order to prevent damage to hydraulic system 56, for example at levels that may only be reached when hydraulic cylinders 26, 32, 34 reach an end-of-stroke position and the flow from the associated pumps 66 is nonzero, or during a failure condition of hydraulic system 56. Each pair of relief valves 88 may connect to first and second pump and head- and rod-end passages 68-74 via different resolvers 92, such that a higher-pressure fluid of first pump and rod-end passages 68, 72 may be relieved to common passage 90 via set of resolvers 92, and a higher-pressure fluid of second pump and head-end passages 70, 74 may be relieved to common passage 90 via a remaining resolver 92.

Charge circuit 64 may include at least one hydraulic source fluidly connected to common passage 90 described above. In the disclosed embodiment, charge circuit 64 has two sources, including a charge pump 94 and an accumulator 96, which may be fluidly connected to common passage 90 in parallel to provide makeup fluid to meterless circuits 58, 60, 62. Charge pump 94 may embody, for example, an engine-driven, variable displacement pump configured to draw fluid from a tank 98, pressurize the fluid, and discharge the fluid into common passage 90. In one embodiment, charge pump 94 may be an over-center pump that allows for peak-shaving operations, as will be described in more detail below. Accumulator 96 may embody, for example, a compressed gas, membrane/spring, or bladder type of accumulator configured to accumulate pressurized fluid from and discharge pressurized fluid into common passage 90. Excess hydraulic fluid, either from charge pump 94 or from meterless circuits 58, 60, 62 (i.e., from operation of pumps 66 and/or the rotary and linear actuators) may be directed into either accumulator 96 or into tank 98 by way of a charge relief valve 100 disposed in a return passage 102. Charge relief valve 100 may be movable from a flow-blocking position toward a flow-passing position as a result of elevated fluid pressures within common passage 90 and return passage 102. A manual service valve 104 may be associated with accumulator 96 to facilitate draining of accumulator 96 to tank 98 during service of charge circuit 64.

Hydraulic system 56 may be provided with means for recuperating fluid power. In particular, hydraulic system 56 may include at least one high-pressure accumulator 106. In the disclosed embodiment, two high-pressure accumulators 106 are utilized and separated by a two-position (e.g., flow-passing and flow-blocking), solenoid-actuated, combining valve 107. One or both of accumulators 106, depending on system demands, may be selectively connected to particular ones of meterless circuits 58, 60, 62 via combining valve 107 to either accumulate excess pressurized fluid or to discharge previously accumulated fluid. Accumulators 106 may be fluidly connected to first and second pump passages 68, 70 via accumulator passages 108 and 110, respectively, and via a common passage 112. Accumulator valves 114 may be disposed between common passage 112 and accumulator passages 108, 110 and configured to selectively control fluid flow between individual meterless circuits 58, 60, 62 and accumulators 106. Accumulator valves 114 may be two-position (flow-blocking and flow-passing), solenoid actuated valves that are spring-biased toward flow-blocking positions. A manual service valve 116 may be associated with accumulators 106 to facilitate draining of accumulators 106 to tank 98 via a passage 118 during service.

In some embodiments, a valve 120 may be disposed within a passage 122 that connects accumulators 106 to common passage 90. Valve 120 may be a two-position (flow-blocking and flow-passing), solenoid-activated valve that is spring biased toward the flow-blocking position. Valve 120 may be used to facilitate peak-shaving operations. That is, any time accumulators 106 have excess pressurized fluid (or any time pressurized fluid is directed to already full accumulators), the fluid may be directed through passage 122 and valve 120 into charge circuit 64. This fluid may then be utilized in several different ways, for example to fill low-pressure accumulator 96, to provide makeup fluid to meterless circuits 58, 60, 62 if there is current demand, or to drive charge pump 94 in a direction that reduces a load on or adds capacity to power source 18. It is contemplated that valve 120 may also help protect accumulator 96 from damaging pressure spikes, in some applications. That is, valve 120 may be used to isolate accumulator 96 from excessive pressures, and only open when the pressures of passage 122 are below a threshold pressure. Alternatively, an additional isolation valve 150 may be provided and directly associated with accumulator 96, if desired.

During operation of machine 10, the operator of machine 10 may utilize interface device 46 to provide a signal that identifies a desired movement of the various linear and/or rotary actuators to a controller 124. Based upon one or more signals, including the signal from interface device 46 and, for example, signals from various pressure sensors 126 and/or position sensors (not shown) located throughout hydraulic system 56, controller 124 may command movement of the different valves and/or displacement changes of the different pumps and motors to advance a particular one or more of the linear and/or rotary actuators to a desired position in a desired manner (i.e., at a desired speed and/or with a desired force).

Controller 124 may embody a single microprocessor or multiple microprocessors that include components for controlling operations of hydraulic system 56 based on input from an operator of machine 10 and based on sensed or other known operational parameters. Numerous commercially available microprocessors can be configured to perform the functions of controller 124. It should be appreciated that controller 124 could readily be embodied in a general machine microprocessor capable of controlling numerous machine functions. Controller 124 may include a memory, a secondary storage device, a processor, and any other components for running an application. Various other circuits may be associated with controller 124 such as power supply circuitry, signal conditioning circuitry, solenoid driver circuitry, and other types of circuitry.

Figure 3:
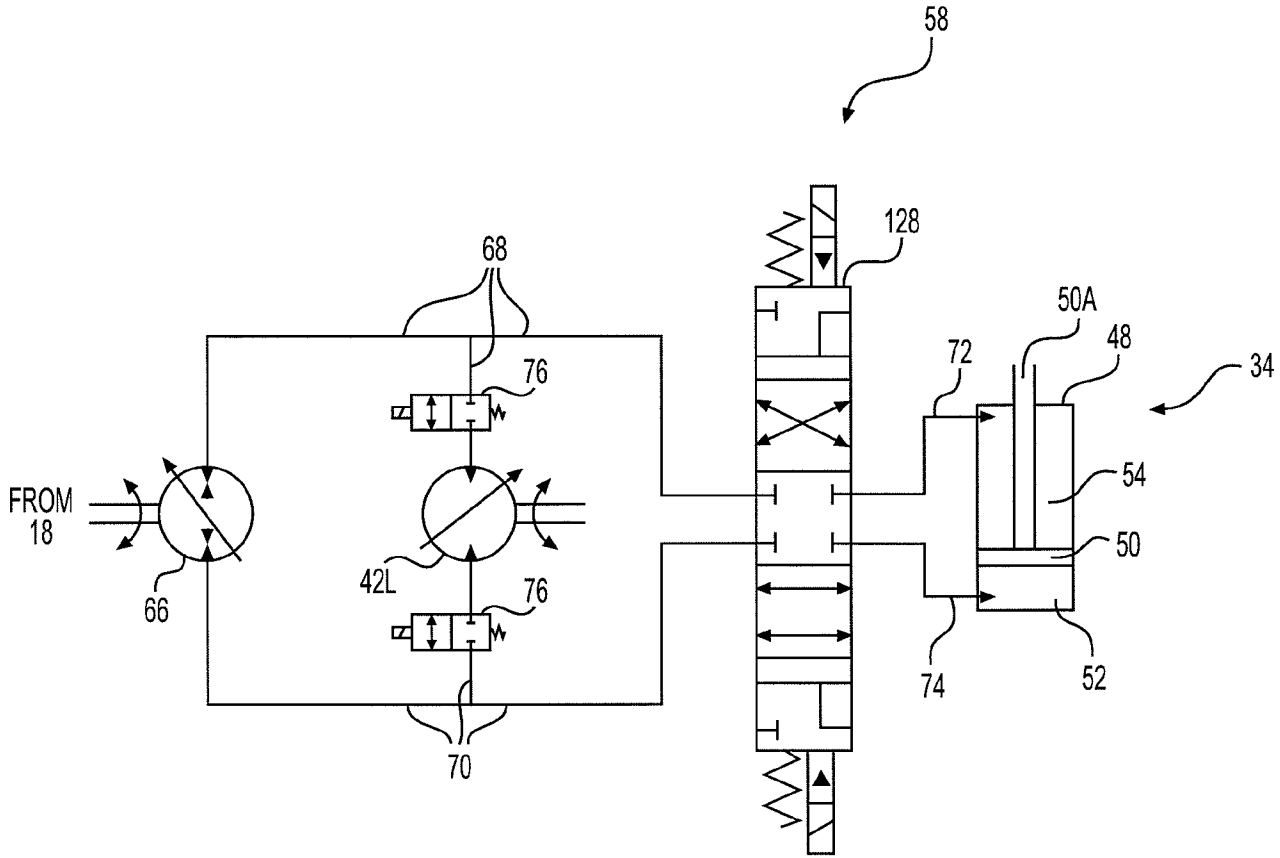
FIG. 3 is a schematic illustration of an exemplary meterless circuit that may be used in conjunction with the hydraulic system of FIG. 2.

An alternative embodiment of first meterless circuit 58 is illustrated in FIG. 3. Like first meterless circuit 58 of FIG. 2, first meterless circuit 58 of FIG. 3 includes pump 66 connected to left travel motor 42L and hydraulic cylinder 34 via first and second pump and rod- and head-end passages 68-74 in closed-loop manner. In contrast to the embodiment of FIG. 2, however, first meterless circuit 58 of FIG. 3 includes a single spool valve 128 in place of valves 78, 80, 82, 84.

Spool valve 128 may be a five-position, solenoid-operated valve, that is spring biased toward a flow-blocking position. In the flow-blocking position, fluid flow between pump 66 and hydraulic cylinder 34 may be blocked. From the first position, spool valve 128 may be moved upward (relative to FIG. 3) one step to a second position, at which first pump passage 68 is fluidly connected with rod-end passage 72 and second pump passage 70 is fluidly connected with head-end passage 74. Further upward movement of spool valve 128 may achieve the third position, at which second pump passage 70 is simultaneously fluidly connected with both rod- and head-end passages 72, 74. From the first position, spool valve 128 may also be movable downward one step to a fourth position, at which first pump passage 68 is fluidly connected with head-end passage 74 and second pump passage 70 is fluidly connected with rod-end passage 72. Further downward movement of spool valve 128 may achieve the fifth position, at which first pump passage 68 is simultaneously fluidly connected with both rod- and head-end passages 72, 74.

The third and fifth positions may be used in a tool float mode of operation. That is, when in the third and fifth positions, work tool 14 may be allowed to float or move under the influence of an outside force (e.g., gravity or a load on work tool 14). When in these positions, fluid may be allowed to flow directly from first chamber 52 to second chamber 54 and vice versa, without first passing through pump 66. This functionality may provide for faster movement of work tool 14 and a reduced load on pump 66 and power source 18.

In the embodiment of FIG. 3, left travel motor 42L may only be isolated from pump 66 and hydraulic cylinder 34 via displacement control, as described above. It is contemplated, however, that isolation valves 76 may additionally be included in the embodiment of FIG. 3, if desired.

Industrial Applicability

The disclosed hydraulic system may be applicable to any machine where improved hydraulic efficiency and performance is desired. The disclosed hydraulic system may provide for improved efficiency through the use of meterless technology. The disclosed hydraulic system may provide for enhanced performance through the selective use of a novel fluid storage configuration. Operation of hydraulic system 56 will now be described.

During operation of machine 10, an operator located within station 20 may command a particular motion of work tool 14 in a desired direction and at a desired velocity by way of interface device 46. One or more corresponding signals generated by interface device 46 may be provided to controller 124 indicative of the desired motion, along with machine performance information, for example sensor data such a pressure data, position data, speed data, pump displacement data, and other data known in the art.

In response to the signals from interface device 46 and based on the machine performance information, controller 124 may generate control signals directed to pumps 66, 94 and to valves 76, 78, 80, 82, 84, 86, 114, 120, 150. For example, to rotate left travel motor 42L at an increasing speed in the first direction, controller 124 may generate a control signal that causes pump 66 of first meterless circuit 58 to increase its displacement and discharge fluid into first pump passage 68 at a greater rate. In addition, controller 124 may generate a control signal that causes isolation valves 76 to move toward and/or remain in their flow-passing positions. After fluid from pump 66 passes into and through left travel motor 42L via first pump passage 68, the fluid may return to pump 66 via second pump passage 70. To reverse the motion of left travel motor 42L, the output direction of pump 66 may be reversed. If, during the motion of left travel motor 42L, the pressure of fluid within either of first or second pump passages 68, 70 becomes excessive (for example during an overrunning condition), fluid may be relieved from the pressurized passage to tank 98 via relief valves 88 and common passage 90. Alternatively or additionally, the pressurized fluid may be directed into accumulators 106 via accumulator passages 108 or 110, valves 114, and common passage 112. In contrast, when the pressure of fluid within either of first or second pump passages 68, 70 becomes too low, fluid from charge circuit 64 may be allowed into meterless circuit 58 via common passage 90 and makeup valves 86.

During the motion of left travel motor 42L, the operator may simultaneously request movement of hydraulic cylinder 34. For example, the operator may request via interface device 46 that hydraulic cylinder 34 be retracted at an increasing speed. When this occurs, controller 124 may generate a control signal that causes pump 66 of first meterless circuit 58 to increase its displacement and discharge fluid into first pump passage 68 at a greater rate. In addition, controller 124 may generate a control signal that causes first rod-end valve 78 and second head-end valve 84 to move toward and/or remain in their flow-passing positions. At this time, second rod-end valve 80 and first head-end valve 82 may be in their flow-blocking positions. As fluid from pump 66 passes into second chamber 54 of hydraulic cylinder 34 via first pump and rod-end passages 68, 72, fluid may be discharged from first chamber 52 back to pump 66 via head-end and second pump passages 74, 70.

The motion of hydraulic cylinder 34 may be reversed in two different ways. First, the operation of pump 66 may be reversed, thereby reversing the flows of fluid into and out of hydraulic cylinder 34. Although satisfactory in some situations, this method of reversing cylinder motion may only be possible when the displacement of left travel motor 42L is also simultaneously reversed (so as to maintain travel in a desired constant direction) or when the left travel motor 42L is already stopped and isolated from hydraulic cylinder 34. Otherwise, the motion of hydraulic cylinder 34 may be reversed by switching the positions of first and second pump and rod- and head-end valves 78, 80, 82, 84. If, during the motion of hydraulic cylinder 34, the pressure of fluid within either of first or second pump passages 68, 70 becomes excessive (for example during an overrunning condition), fluid may be relieved from the pressurized passage to tank 98 via relief valves 88 and common passage 90. Alternatively or additionally, the pressurized fluid may be directed into accumulators 106 via accumulator passages 108, 110, valves 114, and common passage 112. In contrast, when the fluid pressure becomes too low, fluid from charge circuit 64 may be allowed into meterless circuit 58 via common passage 90 and makeup valves 86.

As described above, desired operation of the rotary and linear actuators may drive displacement control of pumps 66. When both rotary and linear actuator motion is simultaneously desired within a single circuit, however, directional displacement control of the associated pump 66 may be driven based solely on the desired motion of the linear actuator (although the displacement magnitude of pump 66 may be based on flow requirements of both the rotary and linear actuator). At this time, in order to cause the rotary actuator to move in a desired direction at a desired speed and/or with a desired torque, the displacement of the rotary actuator may be selectively varied.

As also described above, hydraulic cylinder 34 may discharge more fluid from first chamber 52 during retracting operations than is consumed within second chamber 54, and consume more fluid that is discharged from second chamber 54 during an extending operation. During these operations, accumulator valves 114 may be selectively opened to allow the excess fluid to enter and fill accumulators 106 (when the excess fluid has a sufficiently high pressure, for example during an overrunning condition) or to exit and replenish meterless circuit 58, thereby providing a neutral balance of fluid entering and exiting pump 66.

Regeneration of fluid may be possible during retracting operations of hydraulic cylinder 34, when the pressure of fluid exiting first chamber 52 of hydraulic cylinder 34 is elevated (e.g., during motoring retracting operations). Specifically, during the retracting operation described above, both of makeup valves 86 may be simultaneously moved toward their flow-passing positions. In this configuration, makeup valves 86 may allow some of the fluid exiting first chamber 52 to bypass pump 66 and flow directly into second chamber 54. This operation may help to reduce a load on pump 66, while still satisfying operator demands, thereby increasing an efficiency of machine 10. In some embodiments, makeup valves 86 may be held partially closed during regeneration to facilitate some energy dissipation that improves controllability.

In the disclosed embodiments of hydraulic system 56, flows provided by pump 66 may be substantially unrestricted such that significant energy is not unnecessarily wasted in the actuation process. Thus, embodiments of the disclosure may provide improved energy usage and conservation. In addition, the meterless operation of hydraulic system 56 may, in some applications, allow for a reduction or even complete elimination of metering valves for controlling fluid flow associated with the linear and rotary actuators. This reduction may result in a less complicated and/or less expensive system.

The disclosed hydraulic system may provide for fluid power storage and reuse between multiple, closed-loop, meterless circuits. That is, the configuration of hydraulic system 56 may allow for excess fluid power from one closed-loop meterless circuit to be accumulated and later used within another closed-loop meterless circuit. In addition, because the power is retained in fluid form and directly transferred from circuit to circuit without transformation, an efficiency of the process may be high.

The disclosed hydraulic system may also provide for enhanced pump overspeed protection. In particular, during overrunning retracting operations of hydraulic cylinders 26, 32, 34, when fluid exiting first chambers 52 has elevated pressures, the highly-pressurized fluid may be rerouted back into second chambers 54 via makeup valves 86, without the fluid ever passing through pumps 66. Not only does the rerouting help to improve machine efficiencies, but the bypassing of pumps 66 may also reduce a likelihood of pumps 66 overspeeding.

The disclosed hydraulic system may further provide for improved pressure protection from damaging spikes. In particular, because pressure relief of meterless circuits 58, 60, 62 may be provided at dual locations via resolvers 92 (at locations within first and second upper- and lower-side passages 68-74), the likelihood of damaging pressure spikes developing in these areas is reduced.

It will be apparent to those skilled in the art that various modifications and variations can be made to the disclosed hydraulic system. Other embodiments will be apparent to those skilled in the art from consideration of the specification and practice of the disclosed hydraulic system. For example, although valves 114, 76, 78, 80, 82, and 84 are shown and described as being two-position, on/off type valves, it is contemplated that these valves could alternative be proportional in nature to facilitate additional functionality. For example, if accumulator valve 114 were proportional, accumulators 106 could be simultaneously charged by each of first, second, and third meterless circuits 58, 60, 62, even if all three circuits have different pressures. In this situation, accumulator charging would be done at the lowest pressure and some throttling might be required. In addition, although pumps 66 are described as being over-center type pumps, it is contemplated that pumps 66 may alternatively be unidirectional pumps, if desired. In this situation, energy transferred through the pump (i.e., from any rotary and/or linear actuators) will be limited to a single direction. It is intended that the specification and examples be considered as exemplary only, with a true scope being indicated by the following claims and their equivalents.

What is claimed is:

1. A hydraulic system, comprising:

a pump;

a rotary actuator;

a linear actuator;

a closed-loop circuit fluidly connecting the pump to the rotary and linear actuators, wherein the closed loop circuit includes:

a first pump passage fluidly connected between the pump and the rotary actuator;

a second pump passage fluidly connected between the pump and the rotary actuator;

a first actuator passage fluidly connected to a first chamber of the linear actuator; and a second actuator passage fluidly connected to a second chamber of the linear actuator; and at least one valve configured to switch fluid flow direction from the pump through the linear actuator during fluid flow in a single direction through the rotary actuator, wherein the at least one valve includes:

a first valve disposed between the first pump passage and the first actuator passage;

a second valve disposed between the first pump passage and the second actuator passage;

a third valve disposed between the second pump passage and the first actuator passage; and a fourth valve disposed between the second pump passage and the second actuator passage.

2. The hydraulic system of claim 1, wherein:

the pump is a variable displacement, over-center pump; and operation of the rotary and linear actuators is reversed when fluid flow through the pump is reversed.

3. The hydraulic system of claim 1, wherein the rotary actuator is a variable displacement motor.

4. The hydraulic system of claim 3, wherein the rotary actuator is an over-center type motor.

5. The hydraulic system of claim 1, further including at least one isolation valve configured to isolate the rotary actuator from the linear actuator and from the pump.

6. The hydraulic system of claim 5, wherein the at least one isolation valve includes:

a first isolation valve disposed within the first pump passage; and a second isolation valve disposed within the second pump passage.

7. The hydraulic system of claim 1, further including:

a charge circuit; and at least one makeup valve fluidly connecting the charge circuit to the first and second pump passages.

8. The hydraulic system of claim 7, wherein the at least one makeup valve has a first position at which fluid may flow between the charge circuit and the first and second pump passages substantially unrestricted, and a second position at which fluid may flow from only the charge circuit to the first and second passages and only when a pressure of the fluid is above a threshold pressure.

9. The hydraulic system of claim 8, further including at least one relief valve configured to selectively allow fluid to flow from the first and second pump passages and the first and second actuator passages to the charge circuit based on a pressure of the fluid.

10. The hydraulic system of claim 9, further including at least one resolver configured to fluidly connect a higher one of the first and second pump passages and the first and second actuator passages with the charge circuit.

11. The hydraulic system of claim 1, further including:

an operator interface device configured to receive operator input indicative of a desired movements of the rotary and linear actuators; and a controller in communication with the operator interface device, the pump, and the rotary actuator, the controller being configured to:

adjust operation of the pump based on only desired movement of the rotary actuator when movement of the linear actuator is not desired;

adjust operation of the pump based on only desired movement of the linear actuator anytime movement of the linear actuator is desired; and adjust operation of the rotary actuator based on desired movement of the rotary actuator when movement of both the rotary and linear actuators is desired.

12. A hydraulic system, comprising:

a pump;

a rotary actuator;

a linear actuator;

a closed-loop circuit fluidly connecting the pump to the rotary and linear actuators:

at least one valve configured to switch fluid flow direction from the pump through the linear actuator during fluid flow in a single direction through the rotary actuator:

the closed loop circuit includes:

a first pump passage fluidly connected between the pump and the rotary actuator;

a second pump passage fluidly connected between the pump and the rotary actuator;

a first actuator passage fluidly connected to a first chamber of the linear actuator; and a second actuator passage fluidly connected to a second chamber of the linear actuator; and the at least one valve includes a single spool valve configured to selectively connect the first pump passage to the first or second actuator passages and the second pump passage to the first or second actuator passages, wherein the single spool valve includes a tool float position at which first and second chambers of the linear actuator are fluidly connected to each other and simultaneously fluidly connected to the first pump passage.

13. The hydraulic system of claim 12, wherein:

the tool float position is a first tool float position at which the first and second chambers are fluidly connected to each other and simultaneously fluidly connected to the first pump passage; and the single spool valve includes a second tool float position at which the first and second chambers are fluidly connected to each other and simultaneously fluidly connected to the second pump passage.

14. A hydraulic system, comprising:

a variable displacement, over-center pump;

a variable displacement, over-center motor;

a linear actuator;

a closed-loop circuit fluidly connecting the pump to the motor and the linear actuator;

at least one isolation valve configured to isolate the motor from the linear actuator and from the pump;

at least one valve configured to switch fluid flow direction from the pump through the linear actuator during fluid flow in a single direction through the motor;

an operator interface device configured to receive operator input indicative of a desired movements of the motor and the linear actuator; and a controller in communication with the operator interface device, the pump, and the motor, the controller being configured to:

adjust operation of the pump based on only desired movement of the motor when movement of the linear actuator is not desired;

adjust operation of the pump based on only desired movement of the linear actuator anytime movement of the linear actuator is desired; and adjust operation of the motor based on desired movement of the motor when movement of both the motor and the linear actuator is desired.

15. The hydraulic system of claim 14, wherein:

the closed loop includes:

a first pump passage fluidly connected between the pump and the rotary actuator;

a second pump passage fluidly connected between the pump and the rotary actuator;

a first actuator passage fluidly connected to a first chamber of the linear actuator; and a second actuator passage fluidly connected to a second chamber of the linear actuator; and the at least one valve includes:

a first valve disposed between the first pump passage and the first actuator passage;

a second valve disposed between the first pump passage and the second actuator passage;

a third valve disposed between the second pump passage and the first actuator passage; and a fourth valve disposed between the second pump passage and the second actuator passage.

16. The hydraulic system of claim 14, wherein:

the closed loop includes:

a first pump passage fluidly connected between the pump and the rotary actuator;

a second pump passage fluidly connected between the pump and the rotary actuator;

a first actuator passage fluidly connected to a first chamber of the linear actuator; and a second actuator passage fluidly connected to a second chamber of the linear actuator; and the at least one valve includes a single spool valve configured to selectively connect the first pump passage to the first or second actuator passages and the second pump passage to the first or second actuator passages.

17. A method of operating a hydraulic system, comprising:

pressurizing fluid with a pump;

directing fluid pressurized by the pump to a motor and a linear actuator and returning fluid from the motor and linear actuator to the pump via a closed-loop circuit;

receiving an indication of operator desired movement of the motor and linear actuator; and adjusting operation of the pump based on the indication, wherein adjusting operation includes:

adjusting operation of the pump based on only desired movement of the motor when movement of the linear actuator is not desired;

adjusting operation of the pump based on only desired movement of the linear actuator anytime movement of the linear actuator is desired; and adjusting operation of the motor based on desired movement of the motor when movement of both the motor and the linear actuator is desired.

18. The method of claim 17, further including isolating the motor from the pump and linear actuator when movement of only the linear actuator is desired.

* * * * *